US011999454B2

(12) United States Patent
Bottom et al.

(10) Patent No.: US 11,999,454 B2
(45) Date of Patent: Jun. 4, 2024

(54) SNORKEL ASSEMBLY

(71) Applicants: Michael L Bottom, Ann Arbor, MI (US); Lawrence J Day, Grand Blanc, MI (US)

(72) Inventors: Michael L Bottom, Ann Arbor, MI (US); Lawrence J Day, Grand Blanc, MI (US)

( * ) Notice: Subject to any disclaimer, the term of this patent is extended or adjusted under 35 U.S.C. 154(b) by 332 days.

(21) Appl. No.: 17/323,297

(22) Filed: May 18, 2021

(65) Prior Publication Data

US 2021/0354797 A1 Nov. 18, 2021

Related U.S. Application Data

(60) Provisional application No. 63/026,158, filed on May 18, 2020.

(51) Int. Cl.
*B63C 11/20* (2006.01)

(52) U.S. Cl.
CPC ..... *B63C 11/205* (2013.01)

(58) Field of Classification Search
CPC ..... B63C 11/00; B63C 11/02; B63C 11/12; B63C 11/16; B63C 11/18; B63C 11/186; B63C 11/20; B63C 11/205; B63C 2011/128; B63C 2011/165
See application file for complete search history.

(56) References Cited

U.S. PATENT DOCUMENTS

| | | | | |
|---|---|---|---|---|
| 3,860,042 | A * | 1/1975 | Green | B63C 11/205 128/201.11 |
| 4,610,246 | A * | 9/1986 | Delphia | B63C 11/205 128/205.24 |
| 4,655,212 | A * | 4/1987 | Delphia | B63C 11/205 128/201.11 |
| 5,239,990 | A * | 8/1993 | Delphia | B63C 11/205 128/205.24 |
| 2006/0272637 | A1* | 12/2006 | Johnson | B63C 11/205 128/201.27 |
| 2007/0199565 | A1* | 8/2007 | Ball | B63C 11/205 128/201.27 |
| 2019/0016423 | A1* | 1/2019 | Burt | B63C 11/205 |
| 2020/0156746 | A1* | 5/2020 | Shiue | F16K 1/126 |

* cited by examiner

*Primary Examiner* — Colin W Stuart
(74) *Attorney, Agent, or Firm* — Simonelli IP, PLLC

(57) ABSTRACT

A snorkel assembly includes a mouthpiece and a tube secured thereto. The tube extends between a mouthpiece end and a distal end. A purge valve is disposed adjacent the mouthpiece and the mouthpiece end of the tube. The purge valve allows water and gas to exit the snorkel assembly while preventing water and gas from entering therethrough. The snorkel assembly also includes a check valve secured to the distal end. The check valve allows water and gas to enter the snorkel assembly while preventing water and gas from exiting therethrough.

17 Claims, 5 Drawing Sheets

SNORKEL ASSEMBLY

This application claims priority to U.S. Provisional Patent Application to Michael Bottom and Lawrence Day entitled "Filter Assembly for a Snorkel," application Ser. No. 63/026,158, filed May 18, 2021, the disclosures of which are hereby incorporated entirely herein by reference.

BACKGROUND ART

1. Field of the Invention

The invention relates to a snorkel assembly. More particularly, the invention relates to a snorkel assembly designed to exhaust all air from a swimmer into water.

2. Description of the Related Art

Snorkels are breathing devices that allow for breathing when a mouth and nose are underwater. Typically, snorkels are used for recreational swimming in open water. However, snorkels are also used by those that are training to be a part of a swim team that competes in pools. The competition swimmers (or lap swimmers swimming for exercise) are often near other swimmers as all swimmers need to share the pool or even the lane in the pool. Swimmers need to be able to swim in an environment where the risk for disease transmission is minimized.

SUMMARY OF THE INVENTION

A snorkel assembly includes a mouthpiece and a tube secured thereto. The tube extends between a mouthpiece end and a distal end. A purge valve is disposed adjacent the mouthpiece and the mouthpiece end of the tube. The purge valve allows water and gas to exit the snorkel assembly while preventing water and gas from entering therethrough. The snorkel assembly also includes a check valve secured to the distal end. The check valve allows water and gas to enter the snorkel assembly while preventing water and gas from exiting therethrough.

BRIEF DESCRIPTION OF THE DRAWINGS

Advantages will be readily appreciated as the same becomes better understood by reference to the following detailed description when considered in connection with the accompanying drawings, wherein.

DETAILED DESCRIPTION OF THE DRAWINGS

Figure 1:
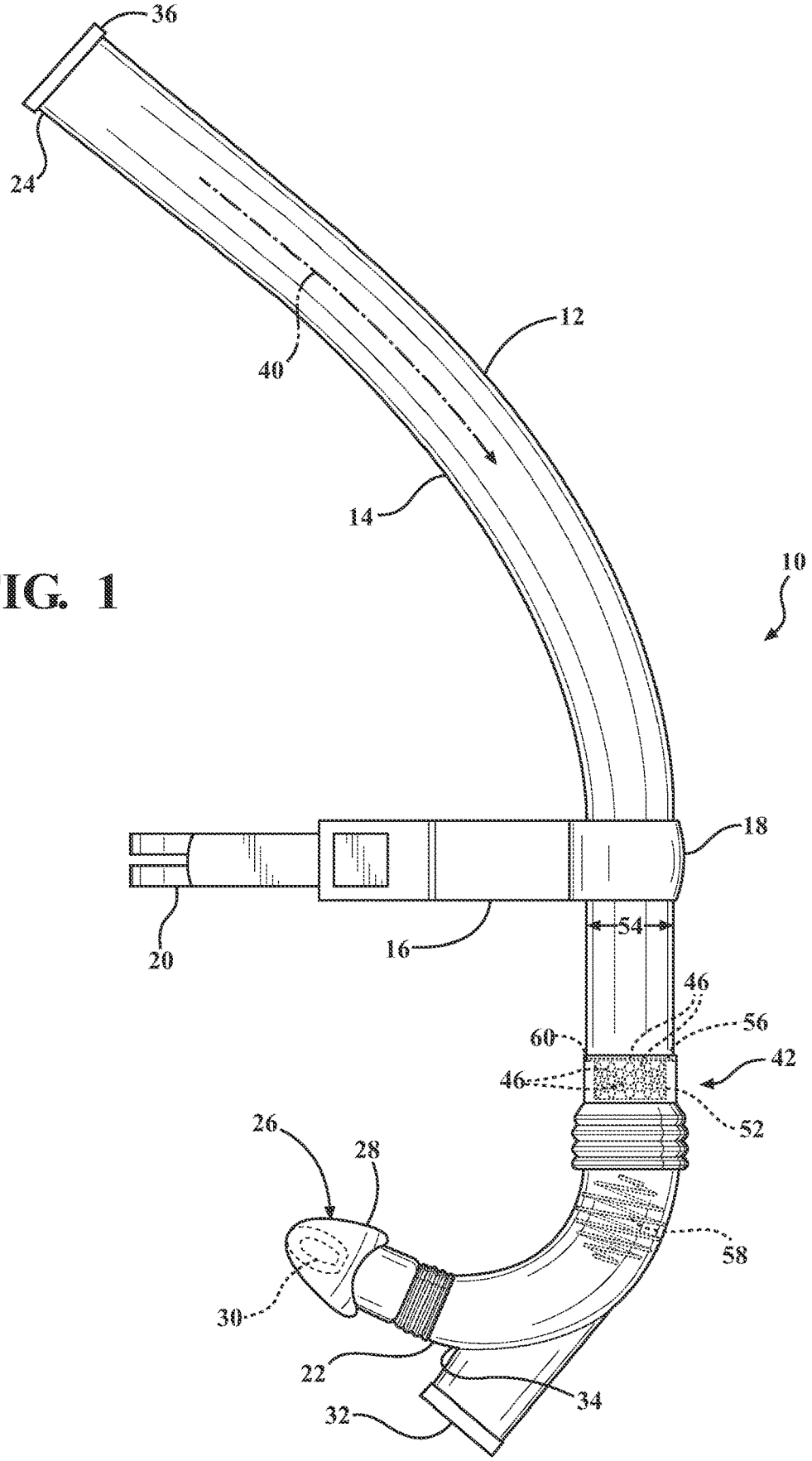
FIG. 1 is a side view of a first embodiment of the snorkel assembly.

Referring to the Figures, like primed reference numerals represent similar elements in the various embodiments described below. If an element has a primed reference numeral, any prior discussion of a similarly referenced element can be considered relevant to that element. As such, discussions of previously discussed elements will not be repeated, and those prior discussions will be considered relevant to all similarly primed reference numerals unless expressly differentiated during the appropriate discussion.

Referring now specifically to FIG. 1, a snorkel assembly is generally indicated at 10. The snorkel assembly 10 provides a pathway for air to be transported from above the water surface to below the water surface to be inhaled by a swimmer without having to lift her mouth above the water surface to breath. The snorkel assembly 10 includes a tube 12. The tube 12 provides the pathway for the air. The tube 12 may have a hollow center. The embodiment shown in FIG. 1 shows the tube 12 having a single wall circular in cross section. It should be appreciated by those skilled in the art that the tube 12 may have cross-sectional shapes other than a circle and may also have more than one tube wall 14 used to complete the tube 12 should the cross-sectional area thereof be something requiring corners to complete.

The snorkel assembly 10 includes head gear, generally shown at 16. The head gear 16 secures the tube 12 in a position relative to the head of the user. The head gear 16 includes a tube section 18 to hold the tube 12 and a head strap 20 to engage the head of the user. It should be appreciated by those skilled in the art that the head strap 20 may include various designs, including a strap portion that extends over the crown of the head and ties to the head strap 20 that is stretched around the head. The head gear 16 may be fabricated from any known elastic material that is resilient and capable of withstanding a chlorinated environment.

The tube 12 extends between a mouthpiece end 22 and a distal end 24. The tube 12 extends through a curved path between the two ends 22, 24. A mouthpiece 26 is fixedly secured to the mouthpiece end 22 of the tube 12. The mouthpiece 26 is designed to provide a seal between the mouth of the user and the tube 12 by having a mouth flange 28 extend through a curved plane out and away from the tube 12, wherein the mouth flange 28 is nested between the gums and lips of the user's mouth. The mouthpiece 26 includes bite pads 30 that extend inwardly from the mouth flange 28 allowing the user to bite down on the mouthpiece 26 to maintain the position of the mouthpiece 26 and, hence, the snorkel assembly 10 with respect to the mouth of the user.

The snorkel assembly 10 includes a purge valve 32 fixedly secured to the tube 12 disposed adjacent the mouthpiece end 22 of the tube 12. The tube 12 may include a Y-shaped joint 34 where the tube 12 extends in two separate directions, the first to the mouthpiece 26 and the second to the purge valve 32. The purge valve 32 allows water and gas (air from the atmosphere or exhaled air) to exit the tube 12 while preventing water and gas from entering the tube 12. In other words, the purge valve 32 is a one-way valve allow water and gas to exit the tube 12.

The snorkel assembly 10 also includes a check valve 36. The check valve 36 is fixedly secured to the distal end 24 of the tube 12. The check valve 36 allows primarily gas (air from the atmosphere) to enter the tube 12 while preventing gas and any water that may be in the tube 12 from exiting therethrough. More specifically, the check valve 36 is a one-way valve allowing gas to enter the tube 12.

The check valve 36 will also allow water to enter the tube 12. While too much water in the tube 12 will inhibit breathing, some water in the tube 12 can be tolerated and even preferred. If the water is chlorinated, it will assist in the destruction of air-borne viruses and diseases that may be in the air. By way of example only, chlorinated water is known to kill coronaviruses such as the severe acute respiratory syndrome coronavirus 2 (SARS-CoV-2) that was responsible for the Covid-19 pandemic.

The combination of the purge valve 32 at a bottom portion of the tube 12 (near the mouthpiece end 22) and the check valve 36 at the distal end of the tube 12 creates a one-way flow of gas and water from the distal end 24, through the tube 12 and out the purge valve 32. This gas and fluid flow direction is represented by arrow 40. The air that remains in the tube 12 at the end of the user's inhalation is fresh air. The fresh air currently in the tube 12 inhibits the air exhausted from the user from going up the tube 12. Therefore, the exhausted air is sent out of the tube 12 through the purge valve 32 and into the water. This is a preferred flow direction because when the water is chlorinated, the chlorine may kill any viruses exhausted in that air by mixing it with the chlorinated water. Therefore, the combination of the check valve 36 and the purge valve 32 provides a means to allow the user to inhale mostly fresh air and to exhaust her exhaled air into the water for possible treatment by the water (should the water be chlorinated).

To further protect the user while swimming, the snorkel assembly 10 includes a flow disruptor, generally shown at 42. The flow disruptor 42 is disposed within the tube 12 and redirects the water and gas as it passes through the tube 12. More specifically, the flow disruptor 42 prevents the air and water from flowing directly from the distal end 24 to the mouthpiece 26. The flow disruptor 42 interrupts the flow of the air and water. Said another way, the flow disruptor 42 will turbulently mix the air and water as it passes past the flow disruptor 42. By creating this turbulent mix, the flow disruptor 42 will assist in the mixing of the air and the water within the tube 12, which will assist in the exposure of chlorine to any air-borne viruses that may exist in the atmosphere. The flow disruptor 42 includes a baffle 44, consisting of at least one surface defining a plurality of holes 46 that are spaced through the baffle 44. Each of the plurality of holes 46 may have a unique shape. The plurality of holes 46 are shown in the Figures as all being circular in shape for purposes of simplicity.

Figure 2:
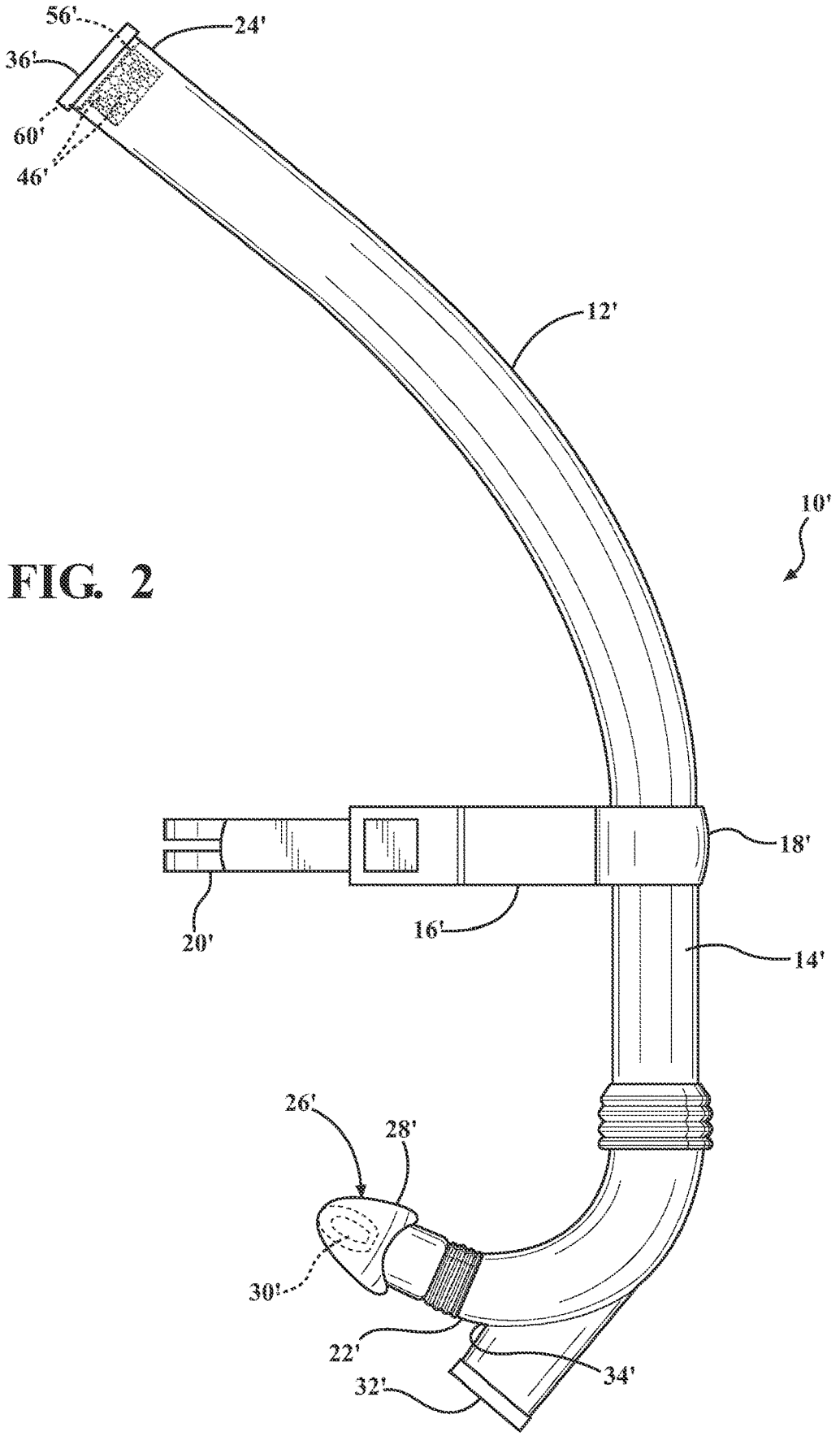
FIG. 2 is a side view of a second embodiment of the snorkel assembly.

In FIG. 1, the flow disruptor 42 is shown within the tube 12 and located between the tube section 18 of the head gear 16 and the Y-shaped joint 34. In FIG. 2, the flow disruptor 42' is disposed immediately adjacent the check valve 36'. It should be appreciated by those skilled in the art that the flow disruptor 42 can be located anywhere along the tube 12 between the distal end 24 and the mouthpiece end 22.

Figure 3:
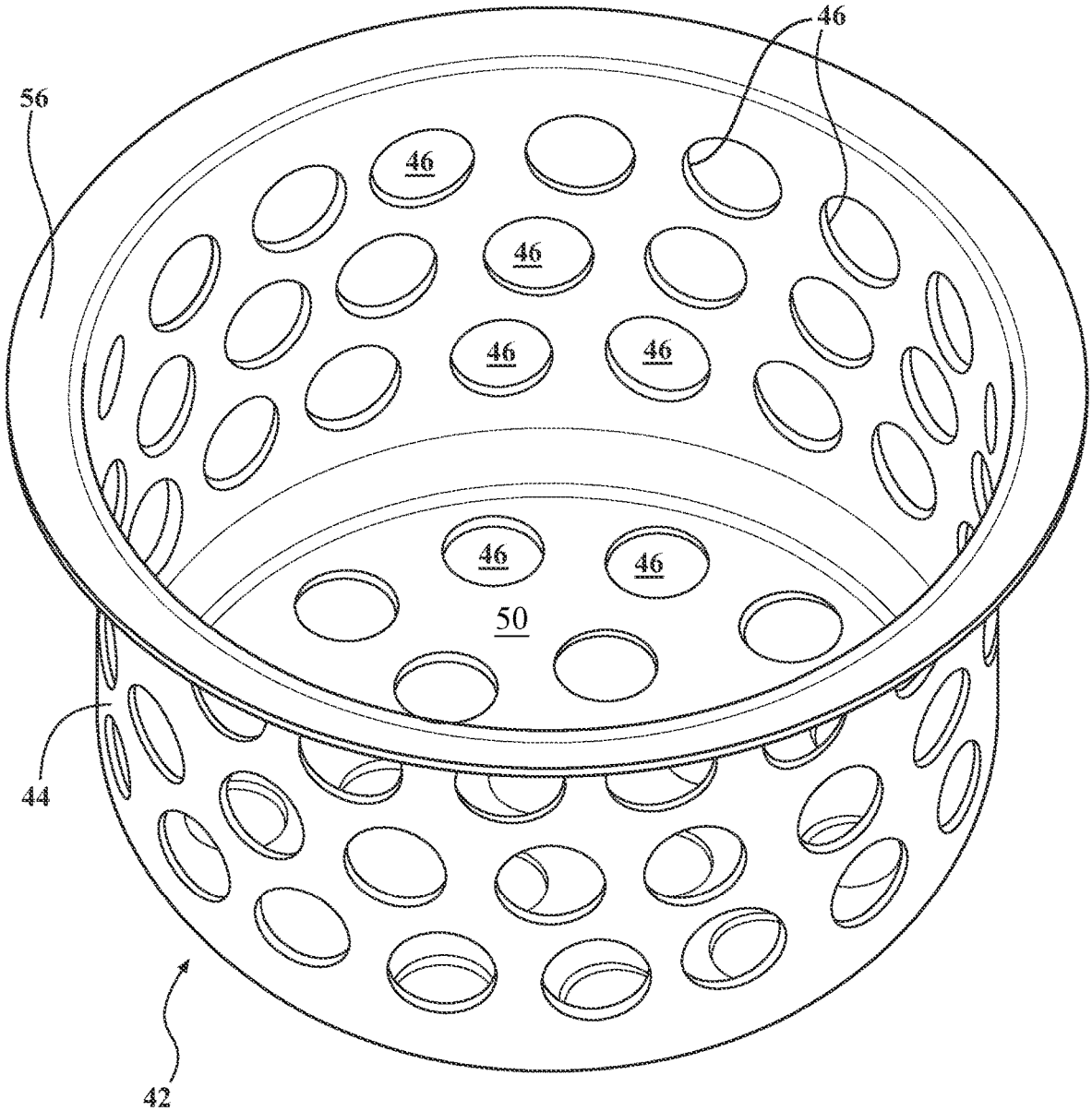
FIG. 3 is a perspective view of a flow disruptor used in the snorkel assembly.

Referring to FIG. 3, the embodiment of the flow disruptor 42 shown in FIGS. 1 and 2 is shown in greater detail. The baffle 44 includes a bottom surface 50 designed to extend across the cross-sectional area of the tube 12. The baffle 44 also includes a cylinder wall 52. The cylinder wall 52 extends around the entire periphery of the bottom surface 50. The periphery of the bottom surface 50 and the diameter defining the cylinder wall 52 are both less than an inner diameter 54 of the tube 12. This allows both the bottom surface 50 and the cylinder wall 52 to contribute to the disruption of the flow of fluid and gas as it passes through each of the plurality of holes 46. The flow disruptor 42 also includes a flange 56 that extends perpendicularly out from the cylinder wall 52 to rest on a relief 60 cut into the tube 12. It should be appreciated by those skilled in the art that the flow disruptor 42 can be made using other shapes (semi-spherical, saw-tooth, and the like) without deviating from this disclosure.

Referring back to FIG. 1, a second flow disruptor 58 is shown in phantom. The second flow disruptor 58 is a coiled piece of material that is press fit into the tube 12. In the embodiment shown, the second flow disruptor 58 is made of stainless steel. The second flow disruptor 58 requires the air and water to move therepast creating flow disruptions or turbulence in the mix of water and air passing over the second disruptor 58. The second flow disruptor 58 can be used in addition to, or in place of the flow disruptor 42.

Figure 4:
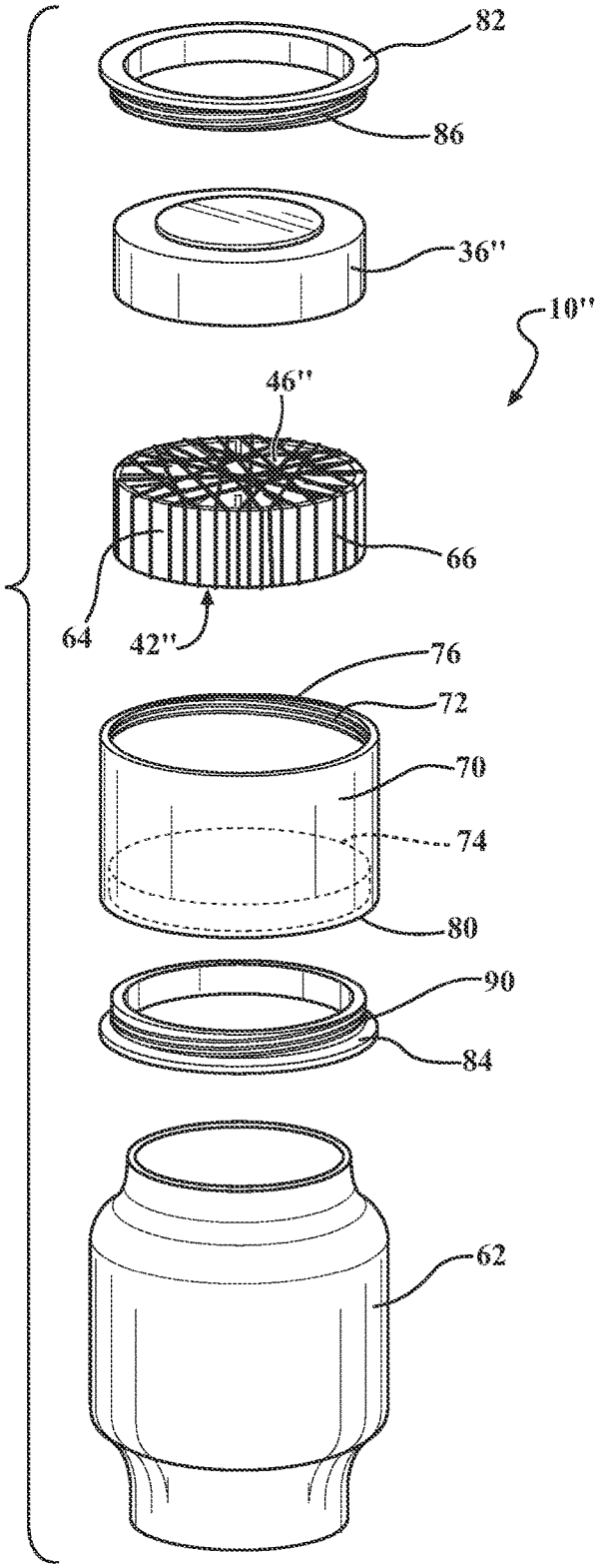
FIG. 4 is an exploded perspective view of third embodiment of a top portion of the snorkel assembly system.

Referring to FIG. 4, a cap 62 is used in an alternative embodiment. The cap 62 sits on the distal end 24 (not shown). The cap 62 houses the flow disruptor 42" and the check valve 36" therein. The flow disruptor 42" includes a baffle cylinder 64 that is wrapped with a thread of material 66. The thread of material 66 is wrapped in such a manner as to create spaces 46" through which the gas and water flow. The flow disruptor 42" sits within a cap cylinder 70 having a pair of threaded sections 72, 74 at upper 76 and lower 80 ends, respectively. End rings 82, 84 each have threaded sections 86, 90 to threadingly engage the threaded sections 72, 74 of the cap cylinder 70 to hold the check valve 36" and the flow disruptor 42" in their respective positions.

Figure 5:
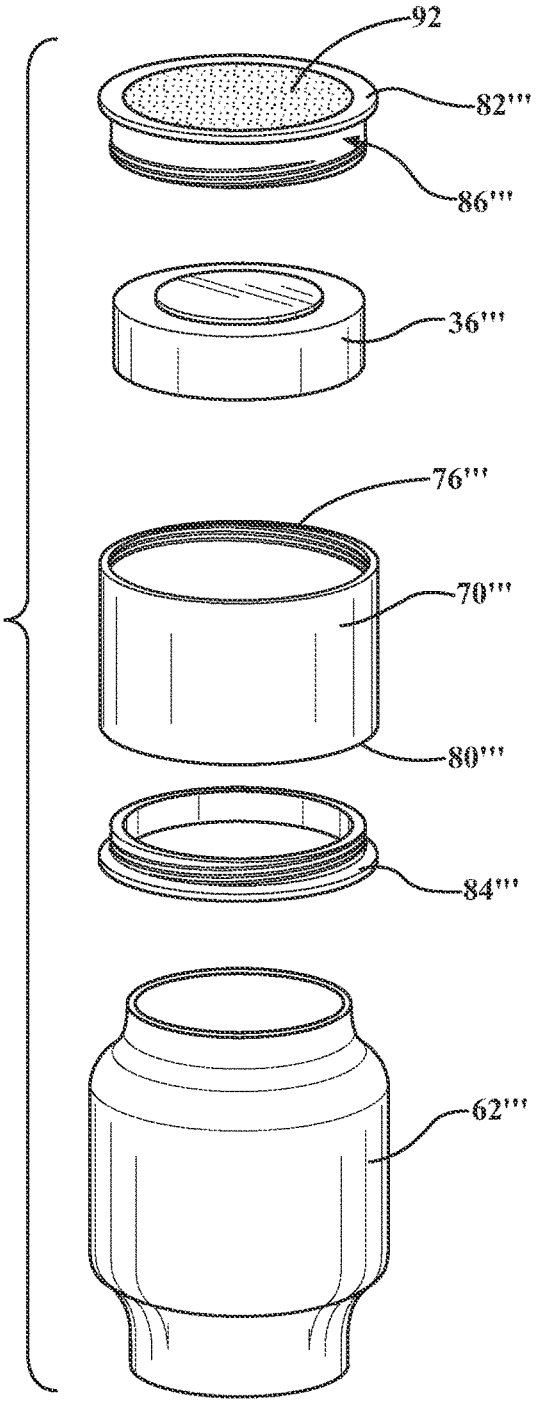
FIG. 5 is an exploded perspective view of a fourth embodiment of a top portion of the snorkel assembly.
Figure 6:
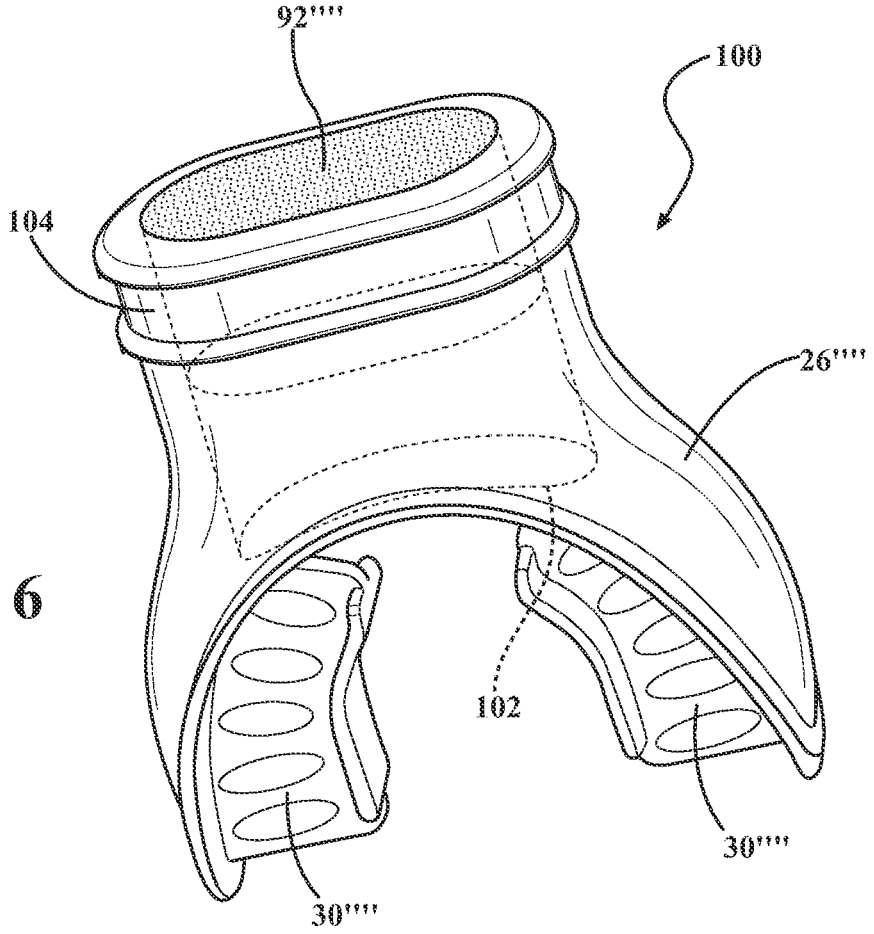
FIG. 6 is a perspective view of an embodiment of a filtration system.

Referring to FIG. 5, a filter 92 is shown to be a part of the end ring 82". If it is determined that a filter 92 is better suited for a particular environment, then it would augment or replace the flow disruptor 42.

There are times when using a snorkel assembly 10 while swimming is not ideal. Those situations include swimming backstroke, recreational swimming, playing in the water, and when swimmers are taking lessons to learn how to swim. In those instances, a mouth snorkel assembly 100 would be appropriate. The mouth snorkel assembly 100 is shown with similar elements as those described above. The mouth snorkel assembly 100 includes a mouthpiece 26"" curved to fit ergonomically into the mouth of a swimmer. Two bite pads 30"" are provided for the swimmer to lightly bite down on to maintain the mouthpiece 26"" in place. The mouthpiece 26"" includes a hollow tube 102 to allow air to pass therethrough. A medium housing 104 is fixedly secured (either by using threads or by being fitted) to the hollow tube 102 and holds the filter 92"" in place to filter the air being inhaled and exhaled by the swimmer. The mouth snorkel assembly 100 will allow for backstroke swimming, playing, lessons, and the like, while still filtering air being inhaled and exhaled.

In another embodiment (not shown), the mouth snorkel assembly 100 includes a purge valve near the mouthpiece 26"" and a check valve on top of the medium housing 104. This will create a one-way flow direction similar to that described in the first two embodiments of the snorkel assembly 10, 10'.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

We claim:

1. A snorkel assembly comprising:

a mouthpiece;

a tube secured to said mouthpiece, said tube extending between a mouthpiece end and a distal end;

a purge valve disposed adjacent said mouthpiece and said mouthpiece end of said tube, said purge valve allowing water and gas to exit said snorkel assembly while preventing water and gas from entering therethrough;

a check valve secured to said distal end, said check valve allowing water and gas to enter said snorkel assembly while preventing water and gas from exiting therethrough; and a flow disruptor disposed within said tube between said distal end and said mouthpiece mixing the water and the gas passing through said flow disruptor as the water and the gas move from said distal end to said mouthpiece, such that the gas exiting the mouthpiece into a user's mouth has been mixed with the water that has entered said tube to disinfect the gas prior to entering the user's mouth when in use.

2. A snorkel assembly as set forth in claim 1 wherein said flow disruptor includes a coiled piece of material disposed within said tube to redirect water and gas as they pass through said tube.

3. A snorkel assembly as set forth in claim 1 wherein said flow disruptor includes a baffle to redirect the water and gas as they pass through said tube.

4. A snorkel assembly as set forth in claim 3 wherein said baffle defines a plurality of holes allowing the water and gas to pass therethrough.

5. A snorkel assembly as set forth in claim 4 wherein said baffle includes at least one cylinder wall and a bottom surface.

6. A snorkel assembly as set forth in claim 5 wherein each of said at least one cylinder wall and said bottom surface include said plurality of holes.

7. A snorkel assembly as set forth in claim 6 wherein a portion of said plurality of holes are circular in shape.

8. A snorkel assembly as set forth in claim 6 wherein said flow disruptor includes a flange extending out from said flow disruptor to position said flow disruptor with respect to said tube.

9. A snorkel assembly as set forth in claim 3 wherein said baffle includes a baffle cylinder with a thread of material wrapped around said baffle cylinder.

10. A snorkel assembly as set forth in claim 1 including a cap securing said check valve on said distal end of said tube.

11. A snorkel assembly comprising:

a mouthpiece;

a tube secured to said mouthpiece, said tube extending between a mouthpiece end and a distal end;

a purge valve disposed adjacent said mouthpiece and said mouthpiece end of said tube, said purge valve allowing water and gas to exit said snorkel assembly while preventing water and gas from entering therethrough;

a cap secured to said distal end of said tube;

a check valve secured to said distal end within said cap, said check valve allowing water and gas to enter said snorkel assembly while preventing water and gas from exiting therethrough; and a flow disruptor disposed within said tube between said mouthpiece end and said distal end mixing the water and the gas passing through said flow disruptor as the water and the gas move from said distal end to said mouthpiece, such that the gas exiting the mouthpiece into a user's mouth has been mixed with the water that has entered said tube to disinfect the gas prior to entering the user's mouth when in use.

12. A snorkel assembly as set forth in claim 11 wherein said flow disruptor includes a baffle to redirect the water and gas as they pass through said tube.

13. A snorkel assembly as set forth in claim 12 wherein said baffle defines a plurality of holes allowing the water and gas to pass therethrough.

14. A snorkel assembly as set forth in claim 13 wherein said baffle includes at least one cylinder wall and a bottom surface.

15. A snorkel assembly as set forth in claim 14 wherein each of said at least one cylinder wall and said bottom surface include said plurality of holes.

16. A snorkel assembly as set forth in claim 15 wherein a portion of said plurality of holes are circular in shape.

17. A snorkel assembly as set forth in claim 16 wherein said flow disruptor includes a flange extending out from said flow disruptor to position said flow disruptor with respect to said tube.

* * * * *